US006176108B1

(12) United States Patent
Bae et al.

(10) Patent No.: US 6,176,108 B1
(45) Date of Patent: Jan. 23, 2001

(54) MOTOR-CLUTCH ASSEMBLY OF A WASHING MACHINE

(75) Inventors: Sang-chul Bae, Seoul; Choul-woo Park, Suwon, both of (KR)

(73) Assignee: Samsung Electronics Co., Ltd., Suwon (KR)

( * ) Notice: Under 35 U.S.C. 154(b), the term of this patent shall be extended for 0 days.

(21) Appl. No.: 09/182,675

(22) Filed: Oct. 30, 1998

(30) Foreign Application Priority Data

Jan. 31, 1998 (KR) ..... 98-2727

(51) Int. Cl.[7] ..... D06F 37/40
(52) U.S. Cl. ..... 68/23.7
(58) Field of Search ..... 68/23.6, 23.7

(56) References Cited

U.S. PATENT DOCUMENTS 2,826,056 * 3/1958 Bruckman ..... 68/23.7
4,317,343 * 3/1982 Gerry ..... 68/23.7
4,969,341 * 11/1990 Burk et al. ..... 68/23.7
5,860,299 * 1/1999 Eum et al. ..... 68/23.7
5,887,458 * 3/1999 Bae ..... 68/23.7

* cited by examiner

*Primary Examiner*—Philip R. Coe
(74) *Attorney, Agent, or Firm*—Burns, Doane, Swecker & Mathis, L.L.P.

(57) ABSTRACT

Disclosed is a motor-clutch assembly of a direct engagement type washing machine. The assembly comprises a section for transmitting a driving force of a motor to a pulsator, a section for transmitting the driving force to a dehydrating tub, and a clutch section for transmitting or cutting off the driving force by using a cam. The clutch section comprises a lower clutch fixed on a driving shaft of the motor, an upper clutch fixed on the driving shaft and engaged with the dehydrating tub driving force transmission section so as to be engaged with or separated from the lower clutch, a clutch guide for supporting the upper clutch, a cam member for guiding the clutch guide up and down, a cam gear for moving the clutch guide along the cam member, and a lever gear for rotating the cam gear. The clutch guide is moved up and down by the rotation of the cam gear. Then, the upper clutch is moved up and down so as to be engaged with or separated from the lower clutch. The clutching operation is performed smoothly even when the washing machine is declined, or vibrates.

6 Claims, 10 Drawing Sheets

MOTOR-CLUTCH ASSEMBLY OF A WASHING MACHINE

BACKGROUND OF THE INVENTION

1. Field of the Invention

This application claims priority under 35 U.S. C. §§119 and/or 365 Patent Application No. 98-2727 filed in Korea on Jan. 31, 1998; the entire content of which is hereby incorporated by reference.

The present invention relates to a washing machine of a type wherein a motor drive shaft is coaxial with a pulsator rotation axis and whose motor and a clutch assembly are directly engaged with each other, and more particularly to a motor-clutch assembly of such a washing machine.

2. Description of the Prior Arts

A washing machine is an appliance for making a water stream in a washing and dehydrating tub (hereinafter, referred to as a dehydrating tub) by means of a mechanical force. The washing machine thereby stimulates a chemical operation of a detergent as well as applies physical operation, such as a friction, impact and the like to clothes to be washed so as to enhance washing effect in a short time. Recently, a full-automatic washing machine performs a rinsing and a dehydrating process as well as a washing process.

Such a full-automatic washing machine has a pulsator and driving apparatus for driving the dehydrating tub. The pulsator operates to form the water stream in the dehydrating tub, and the dehydrating tub is driven to apply centrifugal force to clothes to be washed during a washing operation. The driving apparatus of the dehydrating tube includes a motor for generating a driving force, and a clutch assembly for reducing the driving force of the motor to a predetermined degree and then selectively transmitting the adjusted driving force to the pulsator and the dehydrating tub.

In the conventional washing machine, the motor and the clutch assembly are connected with each other through a belt. In recent, however, a washing machine is widely used, in which the motor drive shaft is coaxial with a pulsator rotation axis (hereinafter referred to as a direct engagement type washing machine), and wherein the motor drive shaft and the clutch assembly are disposed along a common axis thereof, because of the problems of vibration and noise.

Such a motor-clutch assembly is described with reference to the accompanying drawings as follows.

FIGS. 7 and 8 show a motor-clutch assembly of the direct engagement type washing machine.

As shown in the drawings, the motor-clutch assembly is installed at a lower side of a dehydrating tub 2. The motor-clutch assembly is comprised of a motor 20, a pulsator driving force transmission section 30, a dehydrating tub driving force transmission section 40 and a clutch section 50.

The motor 20 is comprised of a stator 21, a rotor 22, and a driving shaft 23. The pulsator driving force transmission section 30 is comprised of a planet gear assembly 31 for reducing a rotational force of the driving shaft 23, and a pulsator shaft 33 for receiving a rotational force from the planet gear assembly 31 and then transmitting the rotational force to the pulsator 3. The planet gear assembly 31 is comprised of a sun gear 31*a* installed at an upper portion of the driving shaft 23, planet gears 31*b* engaged with the sun gear 31*a* and a ring gear 31*c*. The planet gear assembly 31 is engaged with the pulsator shaft 33 through a carrier 35.

In addition, the dehydrating tub driving force transmission section 40 is formed with the sun gear 31*a*, a gear case 41 rotatably installed at a circumference of the driving shaft 23, a drum 43 installed at an outer surface of the ring gear 31*c* in a state of being engaged with the gear case 41, a dehydrating tub shaft 45 of which bottom portion is engaged with the drum 43, and a flange member 47 engaged between the upper portion of the dehydrating tub shaft 45 and the dehydrating tub 2. The gear case 41 is rotatably supported on a bottom portion of a lower housing 14 by bearings 42, and the drum 43 is rotatably supported on an upper portion of an upper housing 13 by another bearings 44.

A clutch section 50 is comprised of an upper clutch 51, a lower clutch 53, and a clutch lever 55.

The upper clutch 51 is engaged at a lower circumference of the gear case 41 by a spline to be capable of moving up and down. A coil spring 57 is disposed between the upper clutch 51 and the bearings 42 which rotatably support the gear case 41. The coil spring 57 elastically pushes the upper clutch 51 downward.

The lower clutch 53 is fixed on the driving shaft 13 at the upper portion of an upper motor housing 12.

The clutch lever 55 is a Y-shaped member as shown in FIG. 8, and it is capable of pivoting about a pivot shaft 55*a*. The clutch lever 55 is elastically and upwardly supported by a clutch spring 59 which is installed on the pivot shaft 55*a*. Accordingly, the clutch lever 55 supports the upper clutch 51 upwardly to maintain the upper clutch 51 and the lower clutch 53 to be separate from each other. The clutch lever 55 has a pin 55*b* at the rear side thereof which is extended upwardly. Also, the clutch lever 55 has a pair of rollers 55*c* at both front sides thereof which are contacted with a lower surface of the upper clutch 51 so as to prevent the clutch lever 55 from being worn out or generating noise which may occur by the contact with the upper clutch 51.

Meanwhile, a brake band 61 is engaged with a brake spring 63 and a brake lever 65. The brake lever 65 is disposed near the pin 55*b*.

The reference numeral 11 in the drawing denotes a lower housing of the motor, and 15 and 16 denote bearings for supporting the driving shaft to be capable of rotating.

The motor-clutch assembly constructed as above operates as follows.

First, during a washing operation, the motor-clutch assembly keeps the state shown in FIGS. 7 and 8. That is, the clutch lever 55 is elastically supported upwardly by the clutch spring 59, and thereby the upper clutch 51 is separated from the lower clutch 53. Accordingly, the driving force of the motor 20 is not transmitted to the gear case 41 which is rotatably installed at the circumference of the driving shaft 23, but to the sun gear 31*a*. The rotational velocity of the sun gear 31*a* is reduced by the planet gear assembly 31 to be transmitted to the pulsator shaft 33, and then the pulsator 3 engaged with the pulsator shaft 33 is rotated.

Second, during the dehydrating operation, a brake lever 65 is pulled by a drain motor (not shown) for opening/closing a drain valve, whereby the brake lever 65 pivots about a brake supporting pin 65*a*. At this instance, a rotation block 65*b* formed at one side of the brake lever 65 pushes the pin 55*b*, so that the clutch lever 55 pivots downwardly about the pivot shaft 55*a* as shown in FIGS. 9 and 10. Thus, rollers 55*c* of the clutch lever 55 are separated from the lower surface of the upper clutch 51. When the clutch lever 55 is separated from the upper clutch 51, the upper clutch 51 is no longer supported upwardly. Consequently, the upper clutch 51 is moved downwardly by its own weight and elastic force of the coil spring 57, and then is engaged with the lower clutch 53.

As the upper clutch 51 and the lower clutch 53 are engaged with each other, the driving force of the motor 20 is now transmitted to the upper clutch 51 through the lower clutch 53 which is rotated along with the driving shaft 23. As the upper clutch 51 is rotated, the gear case 41 engaged therewith by spline is also rotated, and the rotational force generated from the rotational movement thereof is transmitted to the dehydrating tub 2 through the drum 43 engaged with the gear case 41, the dehydrating tub shaft 45 engaged with the drum 43, and the flange members 47. Consequently, the dehydrating tub 2 is rotated to perform the dehydrating process.

However, in the conventional washing machine, the clutch lever 55 supports the upper clutch 51 only by a pair of rollers 55*c* installed at both front sides thereof. Accordingly, the supporting force is not sufficient, so the washing machine may not operate normally if the washing machine is declined or vibrates. Moreover, in case the tension of the clutch spring 59 elastically supporting the clutch lever 55 upwardly is weak, the force for supporting the upper clutch 51 becomes accordingly weak. Therefore, the operation of the clutch is not smoothly performed.

SUMMARY OF THE INVENTION

The present invention has been made to overcome the above-described problems, and accordingly it is an object of the present invention to provide a motor-clutch assembly of a direct engagement type washing machine having more increased amount of force for supporting an upper clutch, thus performing the clutching operation more smoothly.

The above object is accomplished by a motor-clutch assembly of a direct engagement type washing machine comprising: a motor for generating a driving force; a pulsator driving force transmission section for transmitting the driving force of the motor to a pulsator; a dehydrating tub driving force transmission section for transmitting the driving force of the motor to a dehydrating tub; and a clutch section for selectively transmitting and cutting off the driving force of the motor to the dehydrating tub driving force transmission section by using a cam.

The clutch section is comprised of: a lower clutch fixed on a driving shaft of the motor; an upper clutch disposed around the driving shaft of the motor and engaged with the dehydrating tub driving force transmission section so as to be selectively engaged with and separated from the lower clutch; a clutch guide for supporting a lower portion of the upper clutch; a cam member for guiding the clutch guide which is moved upwardly and downwardly; a cam gear for moving the clutch guide along the cam member; and a lever gear for rotating the cam gear.

It is preferable that the clutch section further comprises a coil spring for elastically supporting the upper clutch downwardly.

The clutch guide has a plurality of guide protrusions formed along a circumference thereof, the cam member has a plurality of guide cams on which the guide protrusions of the clutch guide are positioned so as to be guided thereby, and the can gear has a plurality of perpendicular grooves in which ends of the guide protrusions are accommodated.

Furthermore, the upper clutch and the lower clutch are formed with a plurality of teeth-shaped protrusions at area thereof contacting with each other, and a shock reduction member, which is made of urethane, for preventing abrasion and noise caused by a metallic contact are disposed between the upper clutch and the teeth-shaped protrusions of the lower clutch.

In the motor-clutch assembly constructed as above according to the present invention, the clutch guide is moved up and down along the guide cam of the cam member by the rotation of the cam gear. Consequently, the upper clutch supported by the clutch guide is moved up and down. As the upper clutch is moved, the upper clutch is engaged with or separated from the lower clutch so as to transmit or cut off the driving force from the motor to the dehydrating tub.

More specifically, during a washing operation, the clutch guide is moved up along the cam guide of the cam member, whereby the upper and the lower clutches are separated from each other. Accordingly, the driving force of the motor is only transmitted to the pulsator. Likewise, during a dehydrating operation, the clutch guide is moved down along the cam guide of the cam member, whereby the upper and the lower clutches are engaged with each other. Accordingly, the driving force of the motor is simultaneously transmitted to both of the pulsator and the dehydrating tub, so that the latter two are rotated at a high velocity.

According to the present invention constructed as above, the upper clutch is firmly supported by the clutch guide, cam member, and the cam gear, so the clutching operation is performed smoothly even when the washing machine is declined, or vibrates.

BRIEF DESCRIPTION OF THE DRAWINGS

The above object and other advantages of the present invention will become more apparent by describing in detail a preferred embodiment thereof with reference to the attached drawings, in which.

DESCRIPTION OF THE PREFERRED EMBODIMENT

Figure 1:
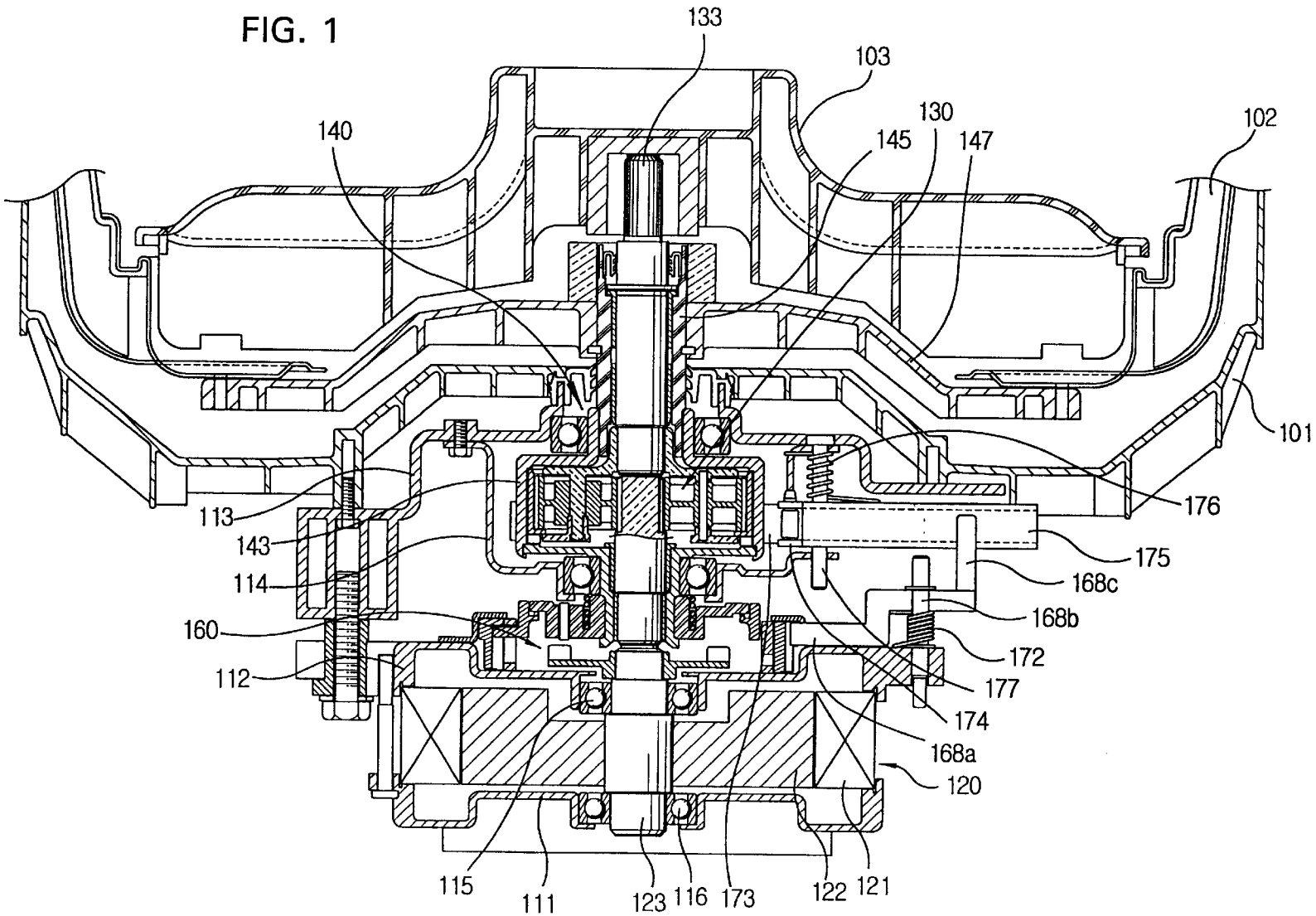
FIG. 1 is a cross sectional view showing a motor-clutch assembly according to the present invention.
Figure 2:
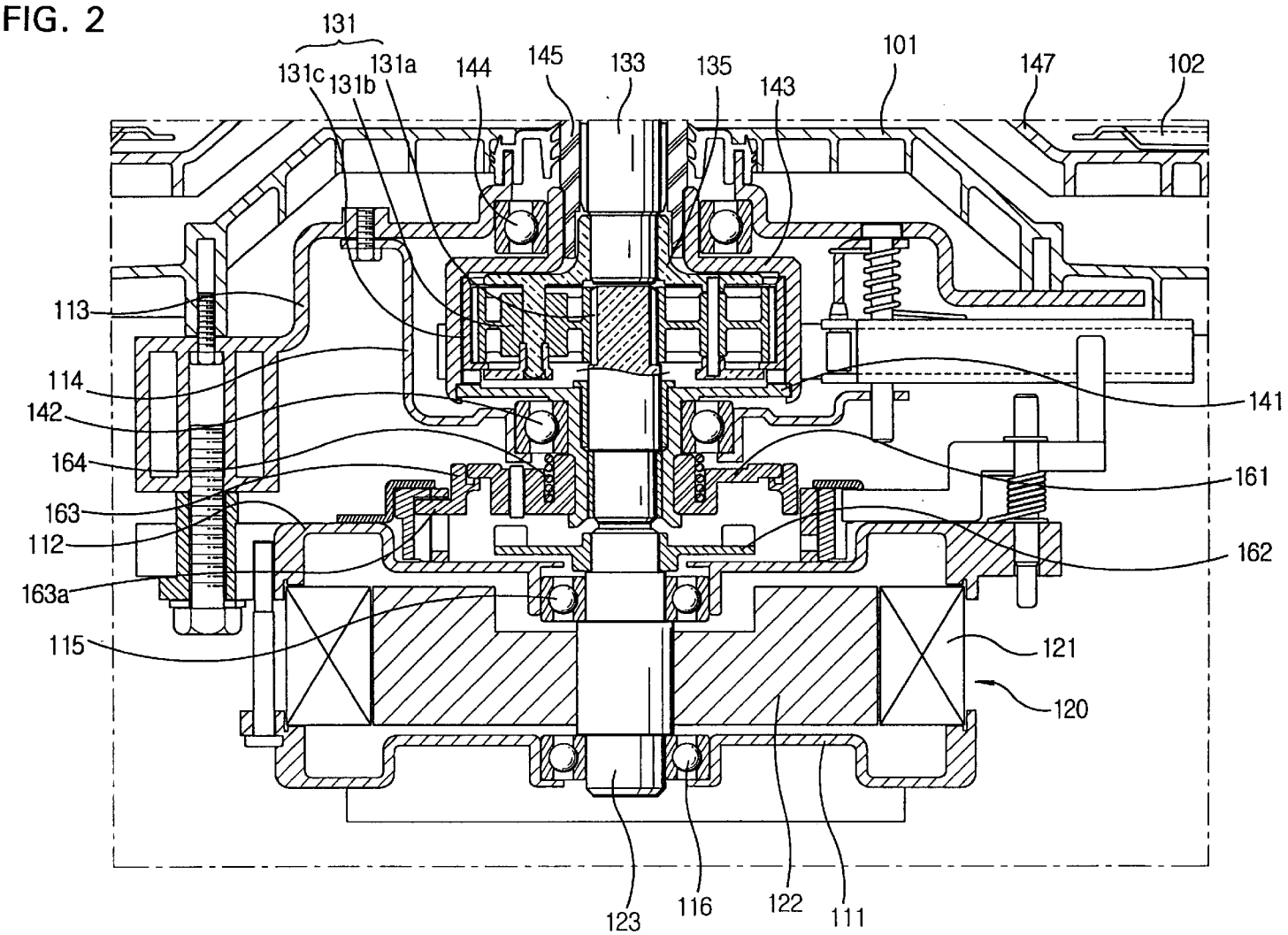
FIG. 2 is a partial enlarged view of FIG. 1.
Figure 3:
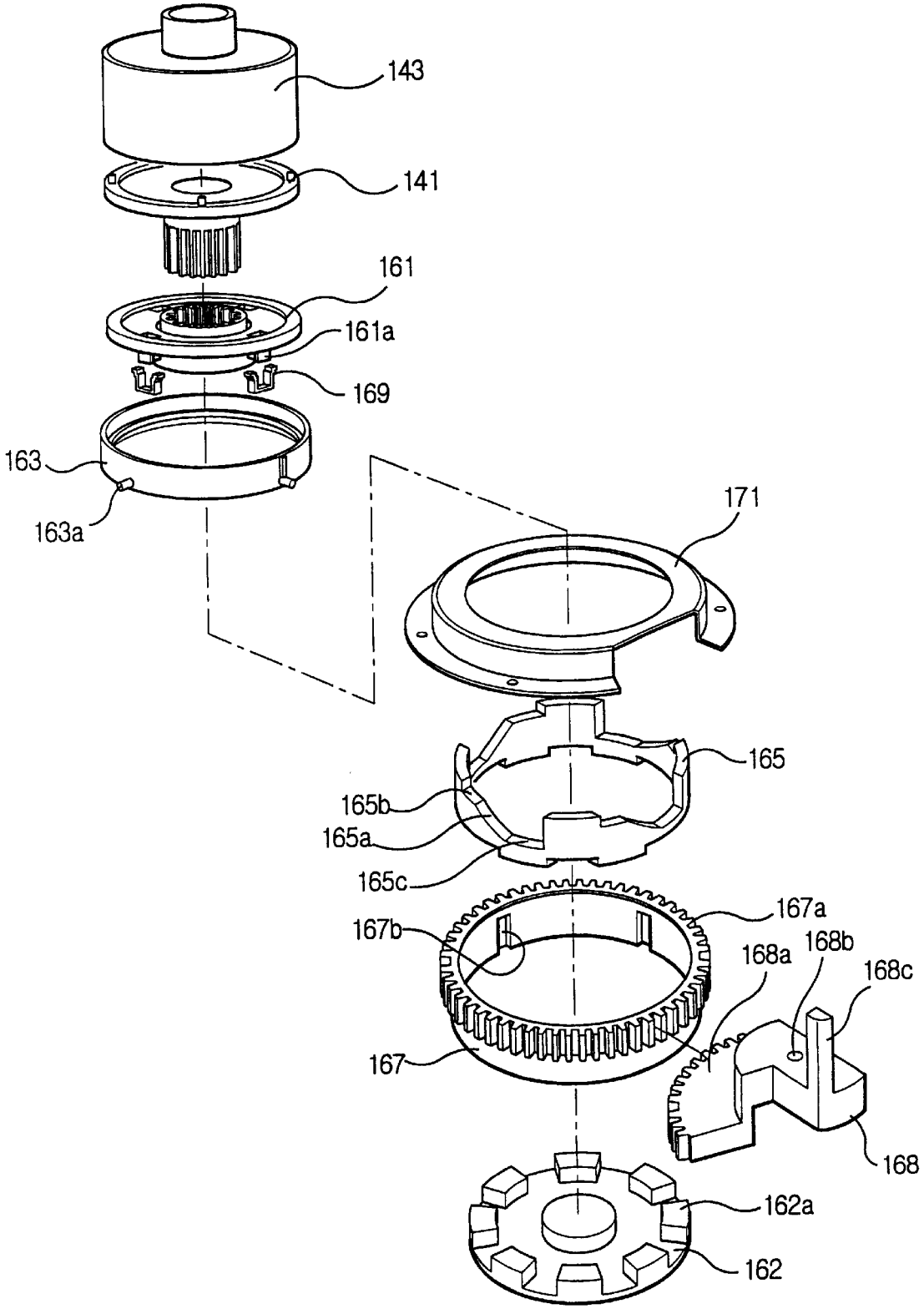
FIG. 3 is an exploded perspective view of a clutch section of the present invention.
Figure 4:
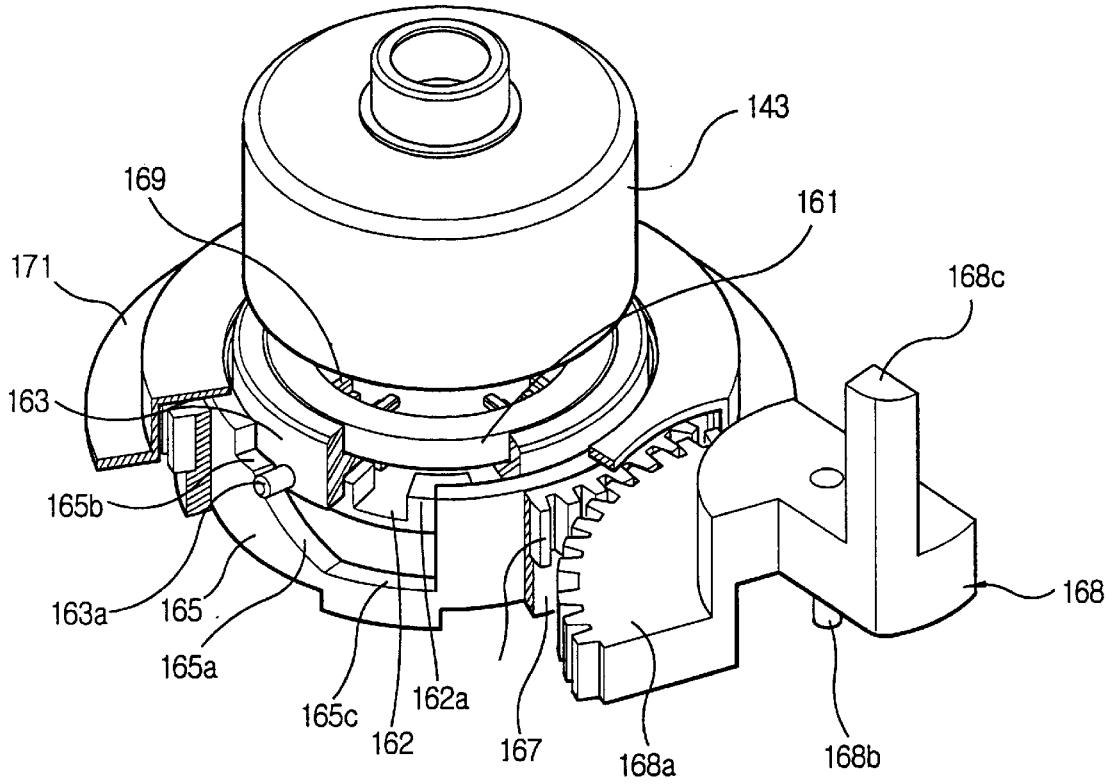
FIG. 4 is a perspective view of a clutch section of the present invention.
Figure 5:
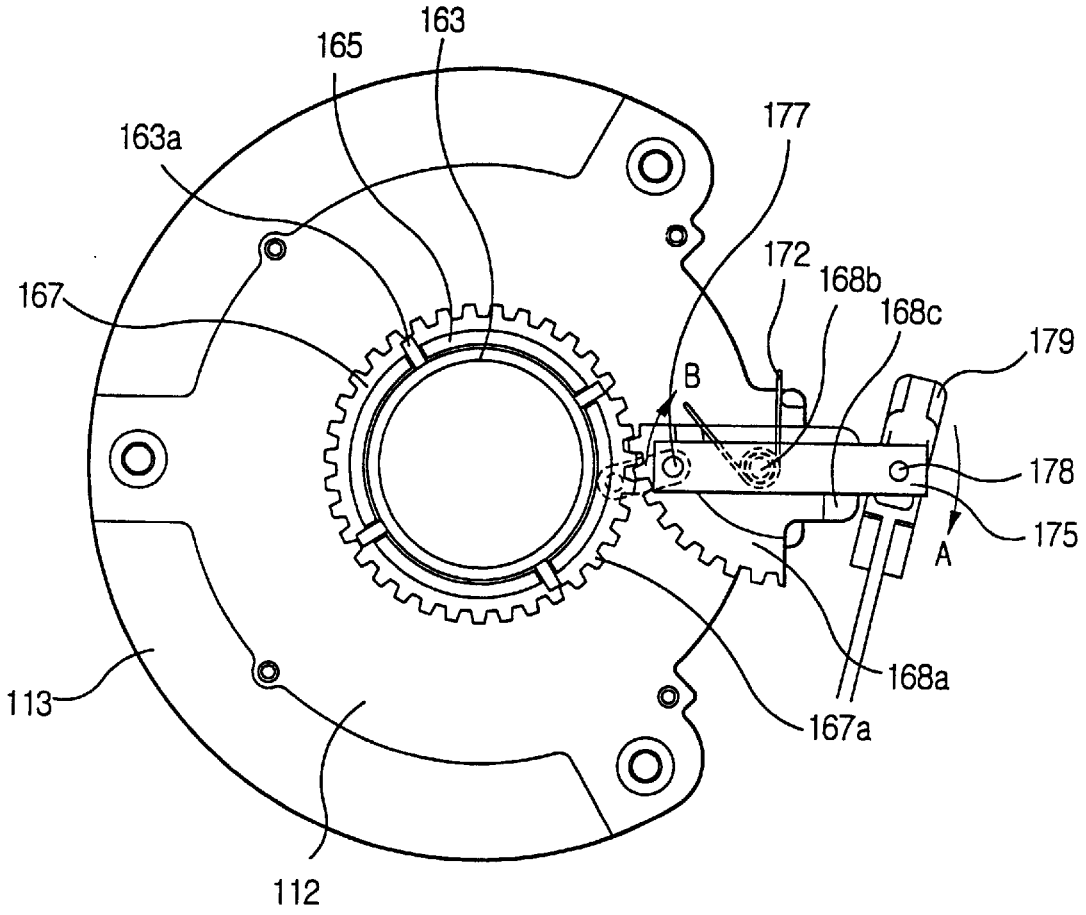
FIG. 5 is a plan view for explaining an operation of the present invention.
Figure 6:
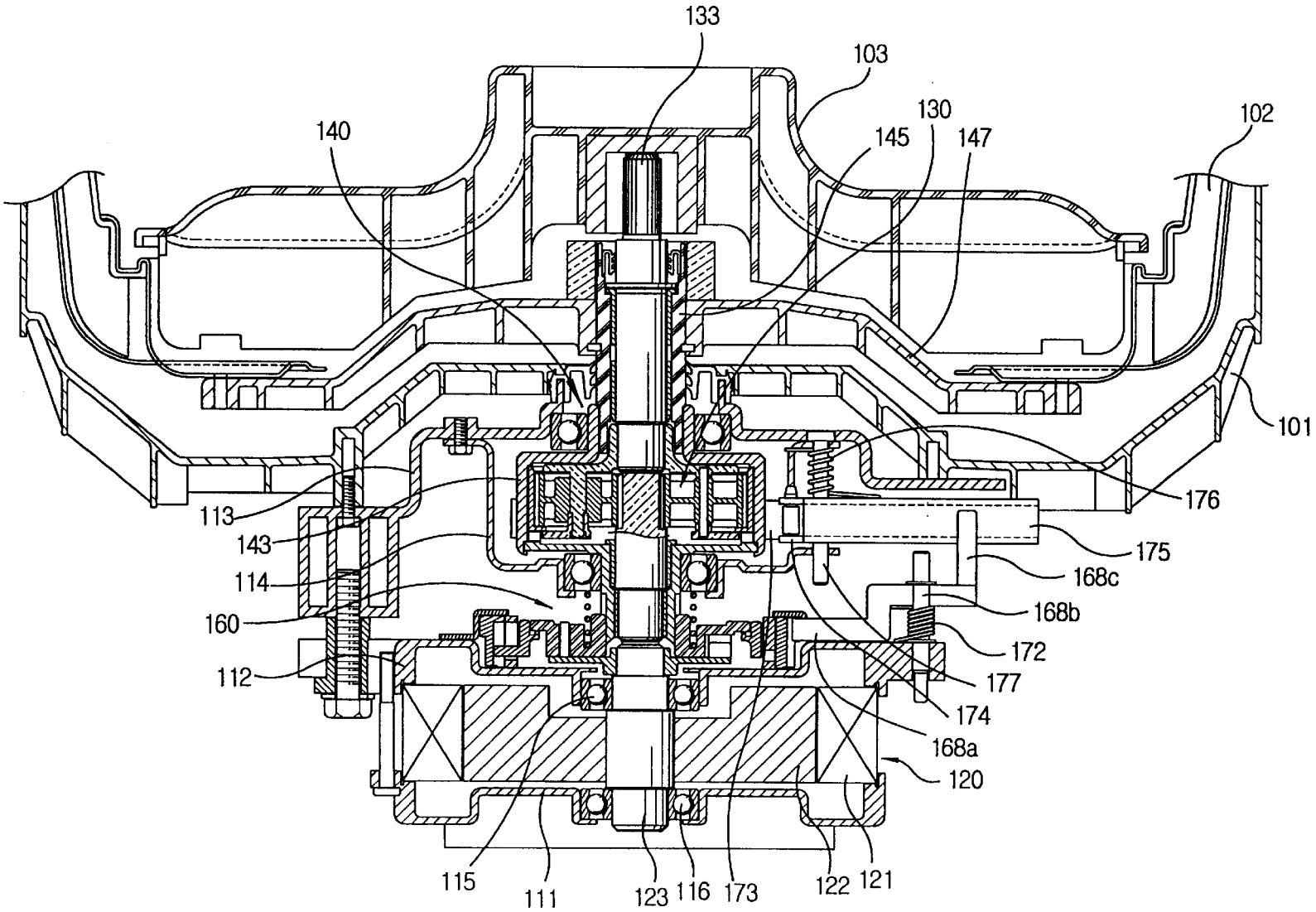
FIG. 6 is a sectional view showing a state of the motor-clutch assembly during a dehydrating operation.
Figure 7:
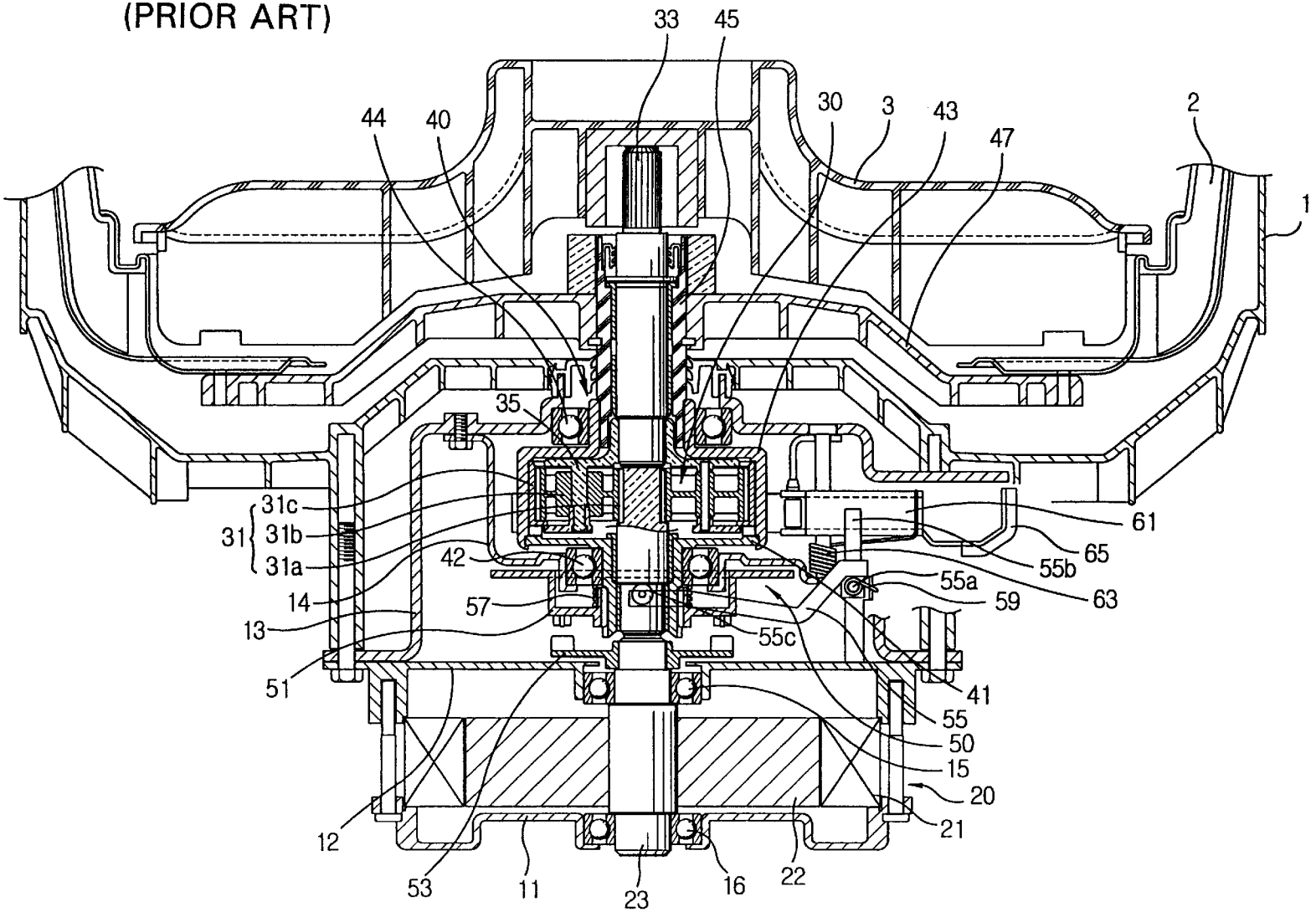
FIG. 7 (PRIOR ART)
FIG. 7 is a sectional view showing a motor-clutch assembly of a conventional direct engagement type washing machine.
Figure 8:
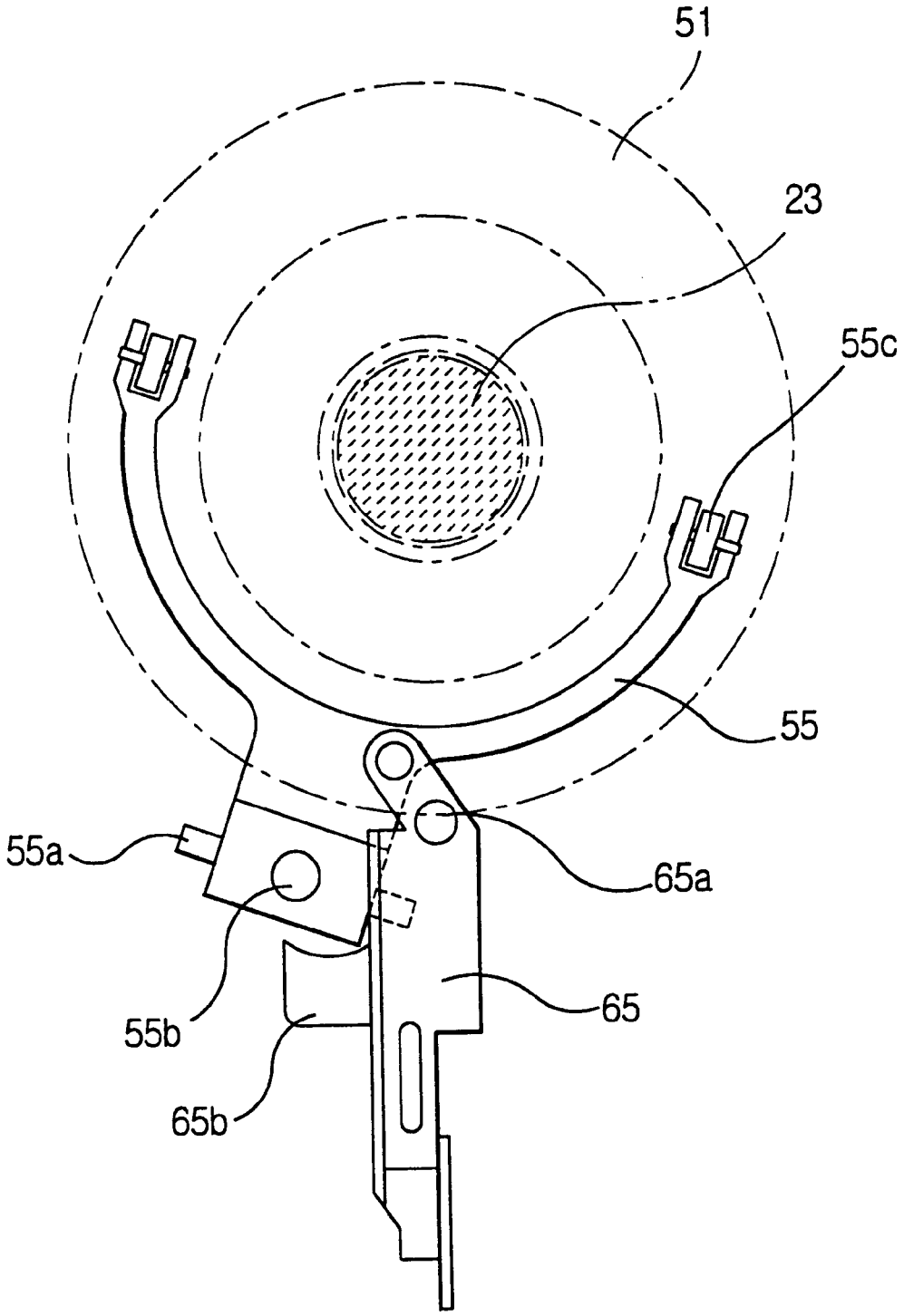
FIG. 8 (PRIOR ART)
FIG. 8 is a partial enlarged transverse sectional view of FIG. 7.
Figure 9:
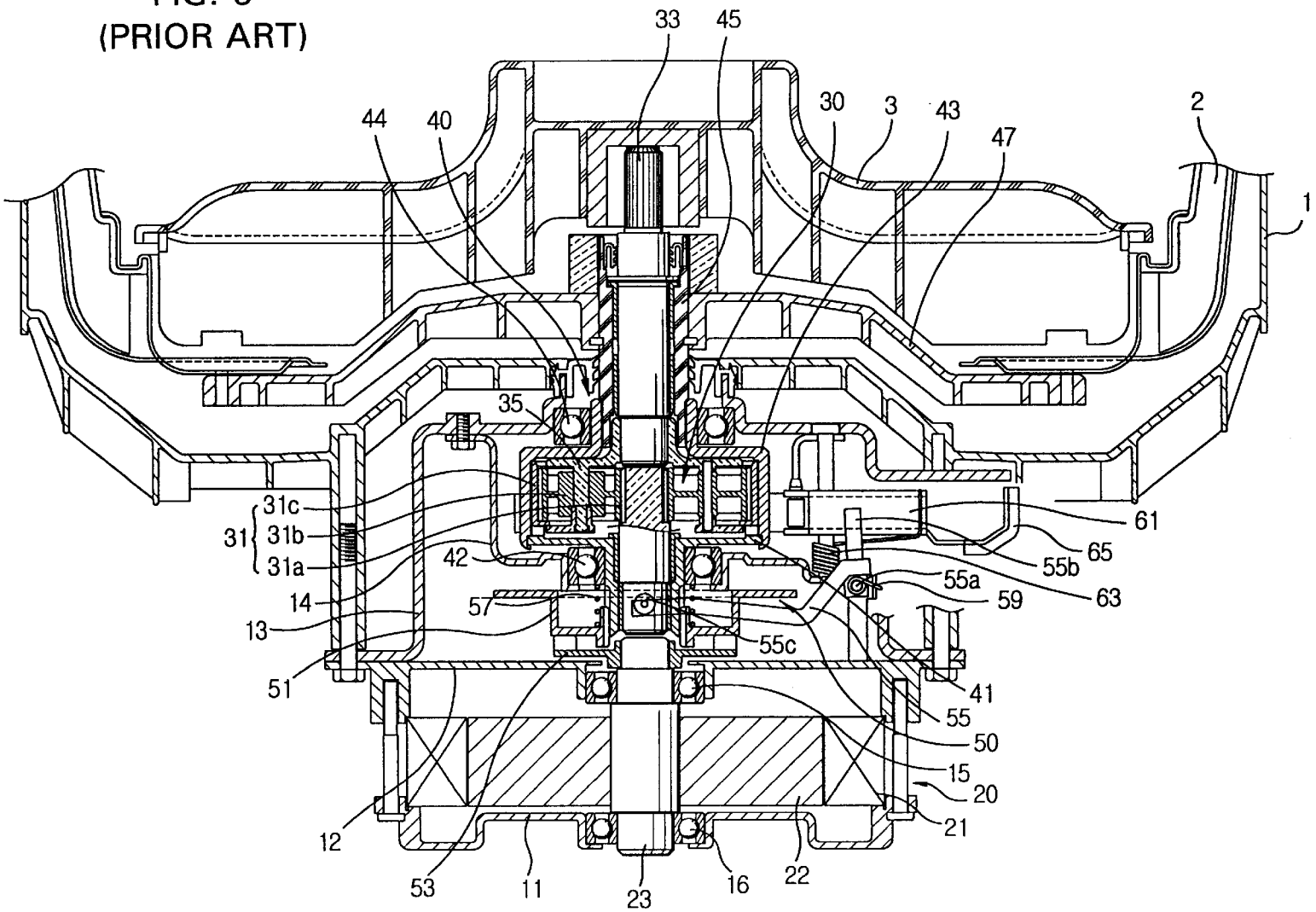
FIG. 9 (PRIOR ART)
FIG. 9 is a sectional view showing a state of the motor-clutch assembly during a dehydrating operation.
Figure 10:
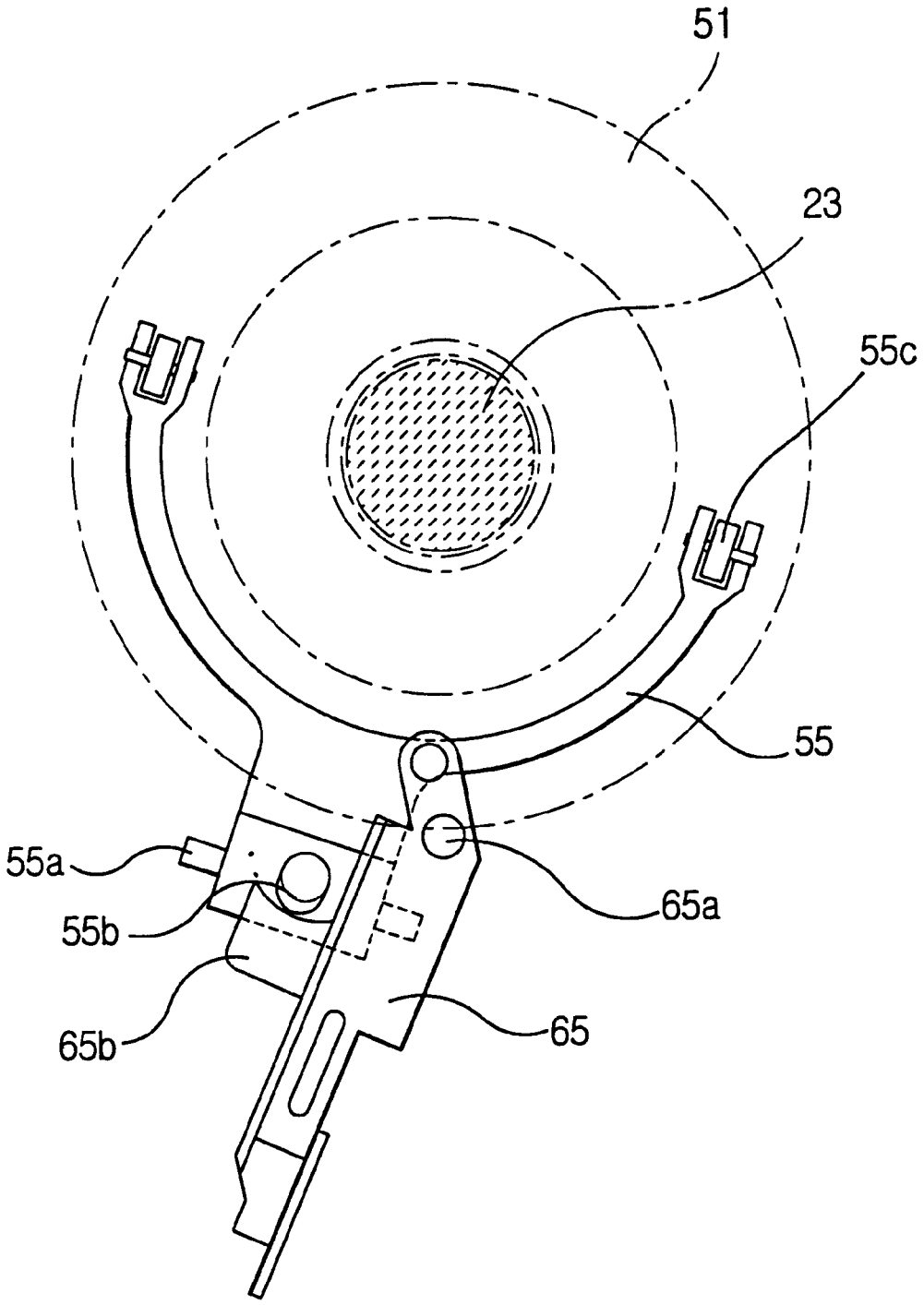
FIG. 10 (PRIOR ART)
FIG. 10 is a partial enlarged transverse sectional view of FIG. 9.

A motor-clutch assembly of a direct engagement type washing machine according to the present invention is shown in FIGS. 1 through 6. FIG. 1 is a cross sectional view showing a motor-clutch assembly according to the present invention, FIG. 2 is a partial enlarged view of FIG. 1, FIGS. 3 and 4 is exploded perspective views of a clutch section of the present invention, FIG. 5 is a plan view for explaining an operation of the present invention, and FIG. 6 is a sectional view showing a state of the motor-clutch assembly during a dehydrating operation.

As shown, the motor-clutch assembly according to the present invention is mainly comprised of a motor 120, a pulsator driving force transmission section 130, a dehydrating tub driving force transmission section 140, and a clutch section 160. More particularly, all the components except the clutch section 160 are constructed in the identical manner with those of the conventional motor-clutch assembly which has been described above. Therefore, additional description of the identical parts will be omitted. Attentions are now invited to a main aspect of the present invention, i.e., a clutch section. The similar components with those described above will be designated with reference numerals that one hundred is added to the reference numerals used in the description of the prior art. For example, the driving shaft denoted by the reference numeral 23 will be designated with a new reference numeral 123.

As shown in detail in FIGS. 2 through 4, the clutch section 160 is comprised of an upper clutch 161, a lower clutch 162, a clutch guide 163, a coil spring 164, a cam member 165, a cam gear 167, and a lever gear 168.

The upper clutch 161 is engaged around a lower portion of the gear case 141 by a spline so that it can be moved upwardly and downwardly. The lower clutch 162 is fixed to the driving shaft 123 at the upper surface of the upper housing 112 of the motor. The upper clutch 161 and the lower clutch 162 respectively have teeth-shaped protrusion parts 161*a* and 162*a* on the area facing to each other. The protrusion parts 161*a* and 162*a* are geared with each other, and intervened with a shock reducing member 169 made of urethane to prevent abrasion and noise generated from the metallic contact.

Between the gear case 141 and the bearings 142 for supporting the upper clutch 161, a coil spring 164 for elastically supporting the upper clutch 161 downwardly is disposed. The upper clutch 161 is installed with a clutch guide 163 at a lower portion thereof, which supports the lower portion of the upper clutch 161. The clutch guide 163 has a plurality of guide protrusions 163*a* protruding along the circumference thereof. The guide protrusions 163*a* are spaced one another by a predetermined distance. The number of the guide protrusions 163*a* is not limited to a certain amount, however, three or four is preferred. The present embodiment shows the example that four guide protrusions 163*a* are provided.

The clutch guide 163 is installed with a cam member 165 at a lower portion thereof. The cam member 165 is fixed to an upper surface of the upper housing 112 of the motor. The cam member 165 has guide cams 165*a* along the circumference thereof, on which the guide protrusions 163*a* of the clutch guide 163 are laid. It is preferable that the guide cams 165*a* have horizontal faces 165*b* and 165*c* at the upper and lower ends thereof so that the guide protrusions 163*a* are safely positioned thereon.

The cam member 165 is installed with a cam gear 167 formed with a gear 167*a* along the circumference thereof. Unlike the cam member 165, the cam gear 167 is installed to be capable of rotating, and is formed with a plurality of perpendicular grooves 167*b* for accommodating the extended ends of the guide protrusions 163*a* at the inner circumference thereof. The reference numeral 171 denotes a cam cover.

Additionally, there installed a lever gear 168 for rotating the cam gear 167. The lever gear 168 is comprised of a gear 168*a* engaged with the gear 167*a* of the cam gear 167, a rotary shaft 168*b*, and a lever 168*c*. The lever gear 168 is elastically supported toward one end thereof by a lever spring 172.

Further additionally, there installed a brake band 173, a brake pin 174, a brake lever 175, a brake spring 176, a brake lever shaft 177, a brake lever pin 178, and the like.

The motor-clutch assembly constructed as above according to the present invention operates as follows.

First, the motor-clutch assembly operates as follows during the washing operation. As shown in FIGS. 1 to 5, the motor-clutch assembly is in the state that the lever gear 168 thereof is elastically supported toward one end thereof, and the guide protrusions 163*a* of the clutch guide 163 are positioned on the upper horizontal face 165*b* of the guide cam 165*a* formed at the cam member 165. Accordingly, the upper clutch 161 positioned at the upper portion of the clutch guide 163 is in a state of being separated from the lower clutch 162. As the motor 120 rotates, the rotational velocity of the driving shaft 123 is reduced through the planet gear assembly 131, then transmitted to the pulsator 103 through the pulsator shaft 133. In this situation, since the driving force of the motor 120 is not transmitted to the dehydrating tub shaft 145 engaged with the upper clutch 161, the dehydrating tub shaft 145 does not rotate. In such a state, the washing operation is performed.

Second, during the dehydrating operation, the brake lever pin 178 engaged with the link 179 is pulled by a drain motor (not shown) which opens/closes a drain valve. Accordingly, the brake lever 175 coupled by the brake lever pin 178 pivots about the brake lever shaft 177 in a direction the arrow A in FIG. 5 points. Also, the lever 168*c* of the lever gear 168 made contact with the brake lever 175 is pushed so that the lever gear 168 rotates on the rotary shaft 168*b* in a direction the arrow B in FIG. 5 points, and the cam gear 167 engaged with the gear 168*a* of the lever gear 168 rotates. Also, as the cam gear 167 rotates, the clutch guide 163 whose guide protrusions 163*a* are accommodated in the perpendicular grooves 167*b* of the cam gear 167 rotates together therewith. By the rotation of the clutch guide 163, the guide protrusions 163*a* move down along the guide cams 165*a* of the cam member 165 and positioned on the lower horizontal face 165*c*. Consequently, the clutch guide 163 and the upper clutch 161 installed at the upper side of the clutch guide 163 also move down. Accordingly, the upper clutch 161 is engaged with the lower clutch 162. In this situation, the upper clutch 161 and the lower clutch 162 are engaged with each other more firmly by the elasticity of the coil spring 164. FIG. 6 shows such a state.

As described, when the motor rotates while the upper clutch 161 and the lower clutch 162 are engaged with each other, the driving force of the motor 120 is subsequently transmitted to the dehydrating tub 102 through the lower clutch 162 fixed on the driving shaft 123, the upper clutch and gear case 141 engaged therewith, the drum 143, the dehydrating tub shaft 145 engaged with the drum 143, and the flange member 147 engaged with the dehydrating tub shaft 145. Then, the dehydrating tub 102 rotates. In this situation, since the ring gear 131*c* engaged with the drum 143 and the sun gear 131*a* formed at the driving shaft 123 rotate together simultaneously, there is no reduction of the rotational velocity in the planet gear assembly 131. Accordingly, the carrier 135 supporting the planet gear assembly 131, the pulsator shaft 133, and the pulsator 103 rotate together at the same rotational velocity with the dehydrating tube 102. Thereby, the dehydrating operation is performed.

When the dehydrating operation ends, a drain valve spring (not shown) returns the link 179 to the state thereof in the washing operation. Along with this, the lever gear 168 is also returned to the initial state by the recovering force of the lever spring 172. Subsequently, as the cam gear 167 rotates, the guide protrusions 163*a* of the clutch guide 163 which are positioned on the guide cam 165*a* of the cam member 165 move upwardly along the guide cams 165*a* and positioned on the upper horizontal face 165*b*. As the guide protrusions 163*a* move upwardly, the clutch guide 163 and the upper clutch 161 installed at the upper portion of the clutch guide 163 also move upwardly. As the upper clutch 161 moves upwardly, the upper clutch 161 is separated from the lower clutch 162 to return to the washing operation state.

According to the present invention as describe above, since the upper clutch is firmly supported by the clutch guide, cam member, cam gear, and so on, the operation is performed smoothly even when the washing machine is declined, or vibrates. In addition, according to the present invention, even when the tension of the lever spring which for elastically supporting the gear lever becomes weak, the force for supporting the cam member, the cam gear, and the clutch guide is not reduced.

While the present invention has been particularly shown and described with reference to a preferred embodiment thereof, it will be understood by those skilled in the art that various changes in form and detail may be effected therein without departing from the spirit and scope of the invention as defined by the appended claims.

What is claimed is:

1. A motor-clutch assembly of a washing machine of a type wherein a motor drive shaft is coaxial with a pulsator rotation axis, the motor-clutch assembly comprising:

a motor for generating a driving force;

a pulsator driving force transmission section for transmitting the driving force of said motor to a pulsator;

a dehydrating tub driving force transmission section for transmitting the driving force of said motor to a dehydrating tub; and a clutch section for selectively transmitting and cutting off the driving force of said motor to said dehydrating tub driving force transmission section by using a cam member, said clutch section comprising:

a lower clutch fixed on a driving shaft of said motor;

an upper clutch disposed around the driving shaft of said motor and engaged with said dehydrating tub driving force transmission section so as to be selectively engaged with and separated from said lower clutch;

a clutch guide for supporting a lower portion of said upper clutch, said cam member arranged for guiding said clutch guide which is moved upwardly and downwardly;

a cam gear for moving said clutch guide along said cam member, and a lever gear for the rotating said cam gear.

2. The motor-clutch assembly as claimed in claim 1, wherein said clutch section further comprises a coil spring for elastically biasing said upper clutch downwardly.

3. The motor-clutch assembly as claimed in claim 1, wherein said clutch guide has a plurality of guide protrusions formed along a circumference thereof, said cam member having a plurality of guide cams on which said guide protrusions of said clutch guide are positioned so as to be guided thereby, and said cam gear has a plurality of perpendicular grooves in which ends of said guide protrusions are accommodated.

4. The motor-clutch assembly as claimed in claim 1, wherein said upper clutch and said lower clutch are formed with a plurality of teeth-shaped protrusions at area thereof contacting with each other.

5. The motor-clutch assembly as claimed in claim 4, wherein a shock reduction member for preventing abrasion and noise caused by a metallic contact are disposed between said upper clutch and said teeth-shaped protrusions of said lower clutch.

6. The motor-clutch assembly as claimed in claim 5, wherein said shock reduction member is made of urethane.

* * * * *